United States Patent [19]

Maggio et al.

[11] Patent Number: 4,520,527

[45] Date of Patent: Jun. 4, 1985

[54] CONCRETE FINISHING TOOL

[76] Inventors: Richard A. Maggio, 27191 Shenandoah, Laguna Hills, Calif. 92653; Leonard C. Maggio, 1520 N. Carol Dr., La Habra, Calif. 90631; Norman L. Hill, 731 E. El Morado Ct., Ontario, Calif. 91764

[21] Appl. No.: 514,237

[22] Filed: Jul. 15, 1983

[51] Int. Cl.[3] ..... E01C 19/44

[52] U.S. Cl. ..... 15/235.8; 15/144 R; 15/144 A; 74/42; 74/89; 74/105; 403/122

[58] Field of Search ..... 15/144 R, 144 A, 235.8; 74/89, 96, 42, 105; 403/76, 77, 114, 122, 131

[56] References Cited

U.S. PATENT DOCUMENTS

| | | | |
|---|---|---|---|
| 1,713,513 | 5/1929 | Abram | 15/235.8 |
| 2,834,199 | 5/1958 | Freeman | 15/235.8 |
| 2,934,937 | 5/1960 | Bennett | 15/235.8 |
| 3,090,066 | 5/1963 | Ferrell et al. | 15/235.8 |
| 3,146,481 | 9/1964 | Chiuchiarelli | 15/235.8 |
| 3,162,881 | 12/1964 | Negwer | 15/235.8 |
| 3,438,661 | 4/1969 | Bowen | 403/77 |
| 3,798,701 | 3/1974 | Irwin et al. | 15/235.8 |
| 4,335,485 | 6/1982 | Paine et al. | 15/235.8 |

*Primary Examiner*—Chris K. Moore
*Attorney, Agent, or Firm*—Jackson, Jones & Price

[57] ABSTRACT

A concrete finishing adapter is disclosed which enables a user to adjust the angle of a bull float or the like, which is adapted for connection to the adapter. The angle of the bull float is adjusted so that it does not gouge into the unset surface of concrete. The adapter includes a base plate, a yoke, a handle receiving member extending through the yoke, a braking sleeve inside the yoke through which the handle receiving member passes, and a rod which connects the handle receiving member to the base plate. Rotation of the handle receiving member in either a clockwise or counter-clockwise direction causes the rod to move the base plate relative to the handle so that the angle of incidence of the base plate (and attached smoothing plate) relative to the concrete surface, is adjusted so that, when the user pushes the smoothing plate away, the forward edge of the smoothing plate is tilted upward. When the user reverses direction of movement and pulls the smoothing plate towards himself, he then rotates the handle so that the rear edge of the smoothing plate is tilted upward.

14 Claims, 6 Drawing Figures

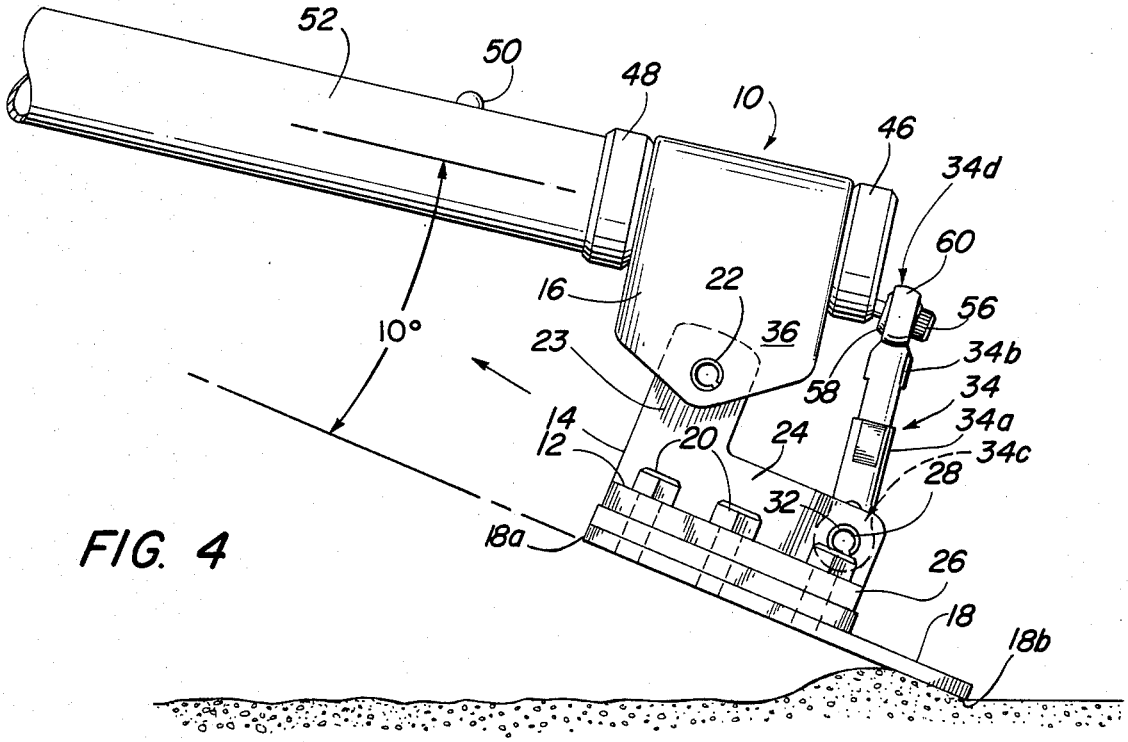
FIG. 4
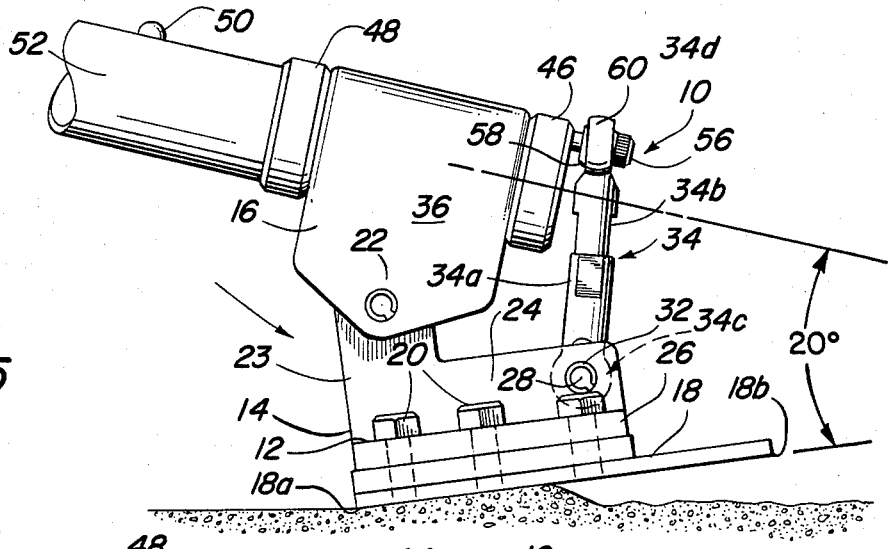
FIG. 5
FIG. 6
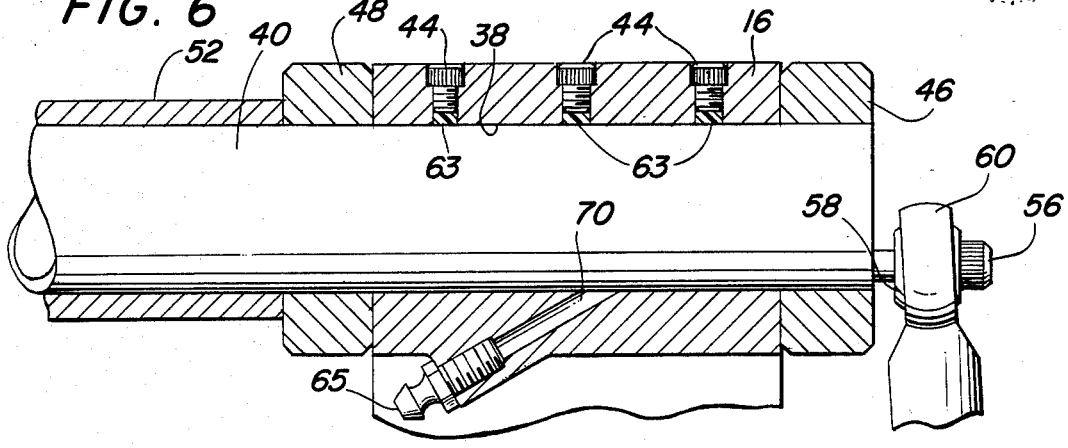

CONCRETE FINISHING TOOL

BACKGROUND OF THE INVENTION

1. Field of the Invention

This invention relates to a concrete finishing tool which allows a user to adjust the angle of a bull float as it is being pulled towards or pushed away from the user.

2. Background Discussion

In providing a smooth finish to large slabs of concrete, a tool called a bull float is used to induce the fine particles of sand and concrete to come to the surface of the slab for subsequent finish troweling. Since the concrete is still unset, it is undesirable to walk over its surface, because this will disturb the natural settling and separation of the particles. It is desired that the fine particles come to the surface and that the larger particles distribute themselves through the lower regions of the concrete. This segregation of particles is facilitated by the use of the bull float, which the user drags back and forth over the surface of the slab.

Long handles are used so that a large surface area may be reached from a single point. Employing long handles presents a problem in using the bull float. If the edge of the bull float is slanted downward in the direction of motion, the float will cut into the concrete rather than smoothing its surface. Since the float is drawn towards the user and then pushed away, it is necessary to change the angle of incidence by either lowering the long handle when pushing the bull float or raising it when pulling the float. This works adequately when the length of the handle is, for example, less than about twelve feet. If, for example, a very long handle twenty feet in length is used, the height required to lift the one end of the handle to prevent gouging the concrete surface will, in many instances, be out of reach of the user or in the range where he can no longer exert sufficient force to pull the float. Similarly, when pushing the float away, to correct the tilt of the edge of the bull float, the handle may have to be lower than the surface of the concrete being prepared.

THE INVENTION

The invention relates to an improved bull float tool which provides a reliable and easy way to change the angle of incidence of the bull float by the user's simple rotation of the handle. The handle may be maintained at a relatively fixed position when manipulating the bull float, at a height that is most convenient for the user. Additionally, because of the simple mechanisms employed, the wet concrete does not interfere with the operation of the tool, either during or after its use.

These and other advantages are embodied in the concrete finishing tool of the present invention which includes a base plate, a yoke, a handle receiving means extending through the yoke, and a throw-rod pivotably connected at one end to the handle receiving means and at its other end to the base plate. The throw-rod tilts the base plate when the user rotates the handle.

The yoke is pivotally mounted to the base plate and has a passageway therein which is disposed generally at right angles to the axis about which the yoke pivots. The handle receiving means, or handle member, is adapted to rotate while being retained in the passageway. A rod, moveable upon rotation of the handle member, is used to control the tilt of the bull float. It has one end operatively connected to the handle member and its other end connected to the base plate. The means so connecting the rod is adapted to allow the end of the rod connected to the handle member to follow the movement of the handle member while it is being rotated and to allow the other end connected to the base plate to pivot universally about a point. This results in the rod revolving about the point of connection to the base plate so that the longitudinal axis of the rod inscribes a cone as the handle member is rotated. Since the rod follows the movement of the handle member and is connected to the base plate, it causes the base plate to tilt.

The bull float is secured to the base plate so that the angle of incidence with respect to the concrete surface of the bull float's forward and rear edges is controlled by the user by turning the handle. Once the user selects the appropriate angle of incidence, the float is held in position. The means for accomplishing this is braking means which interfaces with the surface of the handle member. Frictional force holds the tilt angle of the float as the user manipulates the float. The amount of frictional force is manually adjusted by screw elements which are turned to either increase or decrease this force.

BRIEF DESCRIPTION OF THE DRAWING

The features of the present invention can be best understood, together with the advantages discussed above and other advantages, by reference to the following description taken in connection with the drawing wherein like numerals indicate like parts.

FIG. 4 is a side elevational view of the tool of the present invention with the base plate tilted as far as it goes in one direction.

FIG. 5 is a side elevational view of the tool of the present invention with the base plate tilted as far as it goes in the direction opposite that shown in FIG. 4.

FIG. 6 is a cross-sectional view of an alternate embodiment of the present invention.

DETAILED DESCRIPTION OF THE DRAWING

Figure 2:
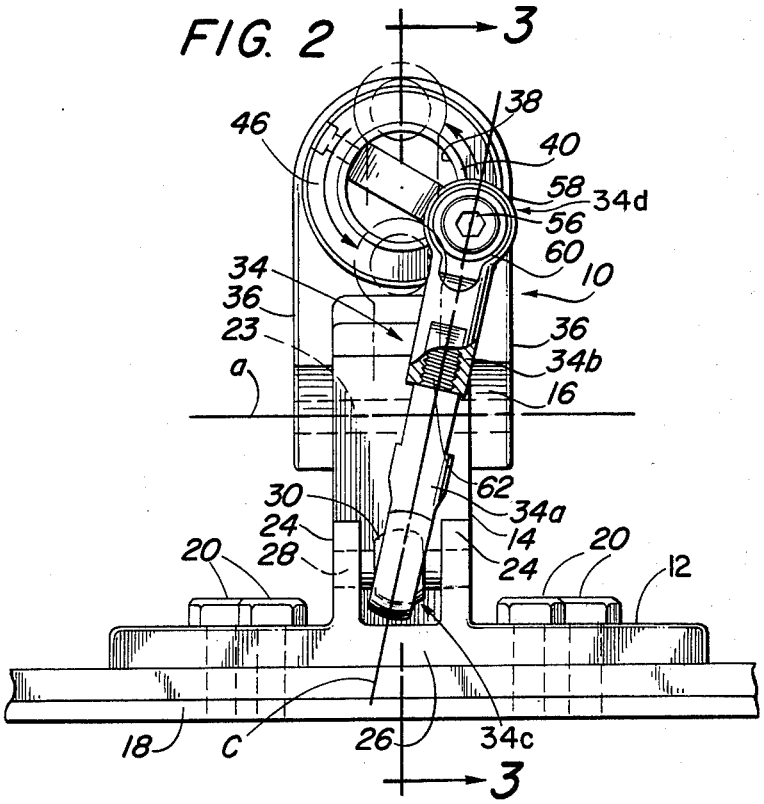
FIG. 2 is a front elevational view of the tool of this invention.

As shown in the Figures, the tool 10 of the present invention includes a base plate 12 having integral therewith an inverted T-shaped strut 14 which is pivotally attached to a yoke 16. The base plate 12 has holes drilled through it on each side of the strut. This enables a bull float 18 to be secured by screws 20 to the underside of the base plate. A press fit bearing member 22 (FIG. 3) is seated in a hole drilled in an upwardly projecting member 23 of the strut 14. This bearing member 22 serves to support the yoke 16 and enable it to rotate or rock to and fro about the axis a (FIG. 2).

The base plate 12 has the strut 14 centrally located and integral therewith. The strut 14 has, integral with the bottom of the member 23 and the base plate 12, two spaced-apart arms 24 which extend upwardly from the bottom of the base plate 12. These arms 24 terminate at the one edge 26 of the base plate 12. A pin 28 having a segmented ball 30 integral with it is seated in a press fit bearing member 32 received in aligned holes drilled in the ends of the arms. This segmented ball serves as one part of a ball and socket connection 34c at the end of a connecting rod 34 mounted at the forward end of the tool 10. As will be described in further detail below, the rod 34 operably attaches the yoke 16 to the base plate 12.

The yoke 16 is a solid metal member having two downwardly projecting sides 36 which straddle the upwardly projecting member 23 of the strut. Through the center of the yoke is a cylindrical passageway 38 with the longitudinal axis b (FIG. 3) of the passageway being generally at right angles to the axis a. The bearing member 22 passes through holes in the sides 36 of the yoke and into holes in the strut member 23, thus pivotably mounting the yoke.

Figure 3:
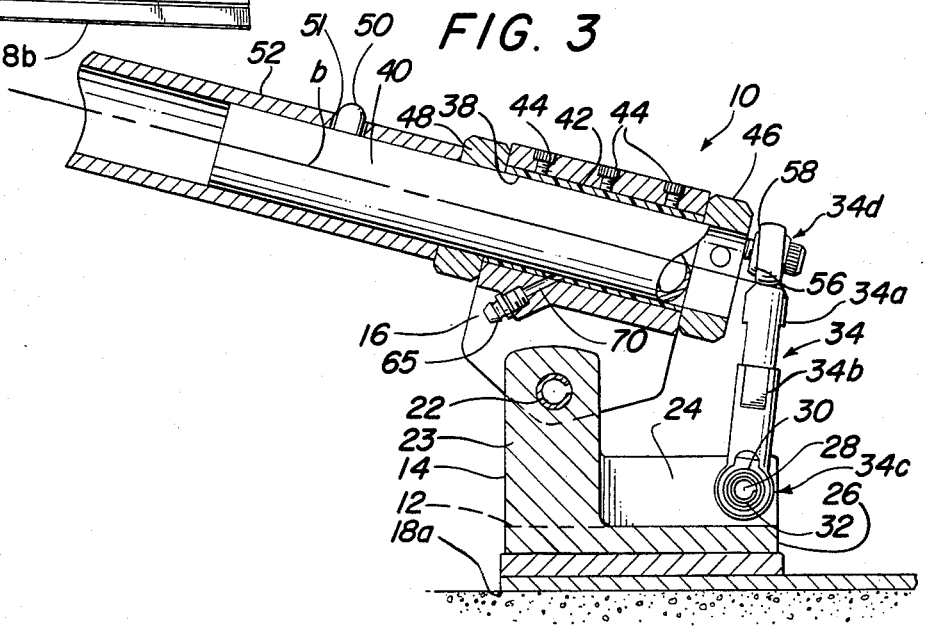
FIG. 3 is a cross-sectional view of the tool of this invention taken along line 3—3 of FIG. 2.

As best shown in FIG. 3, a handle receiving member 40 is received within the passageway 38 and this handle receiving member has a generally annular cross-section with a diameter slightly less than the diameter of the passageway. Also disposed in the passageway is a braking sleeve 42 which has a cylindrical configuration and annular cross-section. The handle receiving member 40 is received within the braking sleeve 42 and is coaxial therewith. The braking sleeve 42 and handle receiving member 40 abut each other so that the inside surface of the braking sleeve touches the outside surface of the handle receiving member 40. Preferably, this braking sleeve 42 is made of a plastic, such as nylon. Such a plastic material, interacting with the surface of the handle member, produces frictional force to hold the handle receiving member 40 in the position selected by the user. The frictional force generated by these interfacing surfaces is controlled by the position of manually adjustable Allen screws 44 which pass through threaded holes in the top of the yoke 16. By tightening these screws 44 one increases the frictional force between the interfacing surfaces of braking sleeve 42 and handle receiving member 40. As will be explained in greater detail below, the braking sleeve 42 enables the base plate 12 to maintain its angle of incidence after an adjustment made by the user.

The handle receiving member 40 is maintained in position by a pair of locking rings 46 and 48 which fit snug around the handle member at opposed ends of the yoke 16. Allen screws (not shown) secure these rings in position so that they hold the handle receiving member 40 so that it does not move longitudinally within the passageway, but enables it to rotate around its longitudinal axis b when it is turned by a handle which is being turned by the user. The end of the handle receiving member 40 has a spring-loaded detent 50, in it which detent extends outwardly from an opening 51 in the handle. This enables an extension 52 to be snapped in position to the handle receiving member 40 and held in this position when the user turns the handle member.

Instead of the conventional way of attaching the extension 52 to the handle receiving member 40 shown in FIG. 3, an alternate approach may be used. For example, a simple threaded extension could be screwed onto a suitable threaded handle member. Such a threaded extension-handle member combination can only be rotated in one direction, however. Rotating it in the opposing direction would unscrew such a handle. This is not the case in the embodiment shown in FIGS. 1–6 where the handle receiving member 40 can be rotated in either a counterclockwise or a clockwise direction.

The connecting rod 34 is attached to the handle receiving member 40 by means of a ball and socket connection 34d secured to the face of the ring 46 by a screw 56. The ball and socket connection 34d is similar to the ball and socket connection 34c connecting the rod 34 to the strut 14, and it includes a segmented ball 58 and socket 60 in the one end of the rod. The screw 56 passes through an opening in the ball 58 and into the face of the ring 46, attaching securely the ball and socket connection 34d to the handle receiving member 40 via the ring 46. The connecting rod 34 is in two pieces, 34a and 34b, connected together by an adjustable and separate threaded stud element 62 as shown in FIG. 2. Because of the way the rod 34 is connected, via element 62, the rod tilts the base plate.

In FIG. 6, the brake sleeve 42 has been eliminated. In its place, the end of the handle receiving member 40 which is within the passageway 38 is coated with Teflon, and nylon plugs 63 are placed into the holes in which the Allen screws 44 are received. Tightening the screws 44 pushes the plugs 63 into contact with the handle receiving member 40, to increase the frictional force being applied. Untightening the screws decreases this force. This is simply an alternate way of providing a braking or holding force to the handle receiving member 40 so that it maintains the position selected by the user.

As best shown in FIGS. 3 and 6, both embodiments of this invention are provided with a channel 70 which runs from the lower part of the passageway 38 to the rear end of the yoke 16. The end of the channel 70 at the rear end of the yoke 16 has a stopper 65 screwed into it, closing it off. This channel 70 provides access to the passageway 38 for introduction of lubrication if necessary. The use of the nylon sleeve 42 in the embodiment shown in FIGS. 1–5 and the use of the Teflon coating in the embodiment shown in FIG. 6 should minimize or avoid the need for lubrication. Nevertheless, particles of concrete dust or dirt may make their way into the passageway and adding lubrication may therefore be desirable in some instances.

OPERATION

Figure 1:
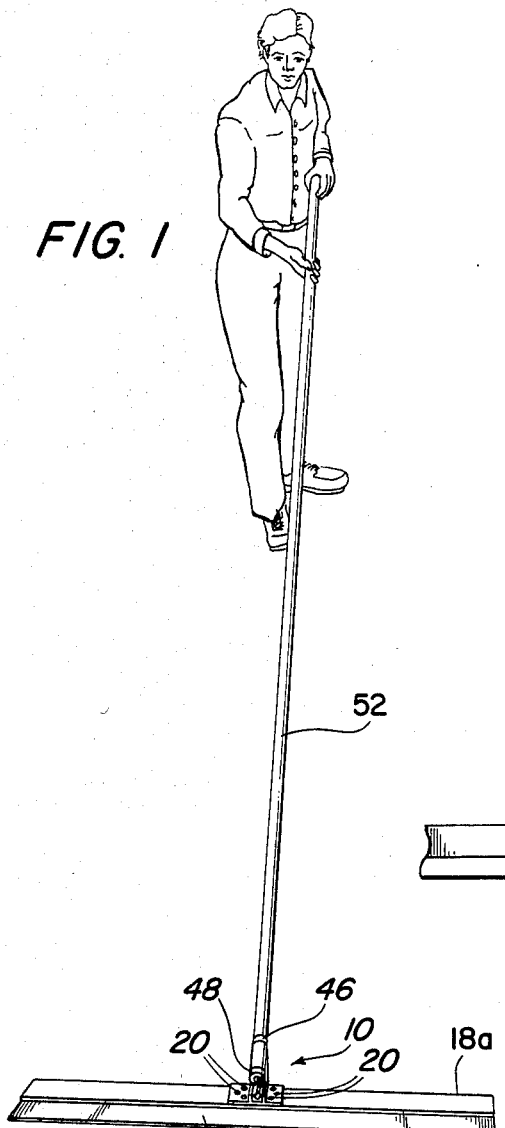
FIG. 1 is a perspective view of a user employing the tool of the present invention to finish the surface of an unset slab of concrete.

As best shown in FIGS. 1, 4 and 5, the tool 10 of this invention is used to manually manipulate the incidence angle of the bull float 18 and change this angle of incidence depending upon whether the bull float is being pulled toward the user or pushed away from the user. The user holds the bull float in position by means of the handle extension 52 and tool 10 of this invention. By manually twisting the handle extension 52, the handle receiving member 40 is rotated within the passageway 38, either counterclockwise or clockwise depending upon the direction of turn. When the handle receiving member 40 is turned, the frictional force between the interfacing surfaces of the braking sleeve 42 (or plugs 63) and handle receiving member 40 is overcome and the handle member rotates within the braking sleeve. When the user stops rotating the handle receiving member 40, the frictional force is sufficient to hold the handle member at the position where rotation stops to maintain the angle of incidence of the base plate 12 as set by the user.

Rotation of the handle receiving member 40 is similar to the operation of a crankshaft of an automobile. When it turns, the rod 34 is actuated to move the base plate relative to the handle receiving member 40 so that the angle of incidence of the one edge 26 of the base plate 12 will be adjusted. Rotation of the handle receiving member 40 causes the rod 34 to pivot about the segmented ball 30 of the ball and socket connection 34*c* and cause the longitudinal axis c (FIG. 2) of the rod to begin to inscribe a cone. The other piece 34*b* of the rod, attached by the ball and socket connection 34*d* to the handle receiving member 40, follows the rotational movement of the handle member and ring 46.

Assume the rod 34, via adjustment of threaded member 62 (FIG. 2) and the base plate 12 are in the position shown by FIGS. 2 and 3 and then the handle receiving member 40 is rotated counterclockwise through a 360° turn. First, the rod 34 will move upwardly. When the handle receiving member 40 has rotated through 90°, the plate 12 will have moved to the position shown in FIG. 5. As the handle member continues to rotate through 180°, the base plate 12 is returned to the position shown in FIG. 3. With continued rotation through 270°, the base plate is in the position shown in FIG. 4. Finally, as the user completes the rotation through 360°, the base plate is returned to the position shown in FIG. 3. Thus, by rotating in only one direction, in this example the counterclockwise direction as viewed in FIG. 2, the user can change the angle of the base plate 12 relative to the surface of the concrete. Because of the braking sleeve 42, once the user via adjustment of threaded element 62 and the two rod pieces 34*a* and 34*b*, has selected the incidence angle of the base plate 12, the sleeve will hold the handle receiving member 40 in position as the user moves the bull float 18.

When the user moves the bull float 18 away from him until he reaches the furthest extent to which he can move it in this direction and begins to draw the bull float towards him, he changes the tilt angle of the base plate 12. He accomplishes this by turning the handle member 40 by rotation of the extension 52 so that the one edge of the base plate is lowered and the other edge is elevated so that upon pulling the base plate towards him, as shown in FIG. 4, the edge 18*a* of this float 18 is raised and does not bite into the surface of the concrete. As shown in FIG. 5, when the user again pushes the bull float away from him, he changes the angle of incidence of the edge 18*b* of the bull float 18 so that this edge 18*b* is now raised upward and the other edge 18*a* is lowered.

The above description presents the best mode contemplated of carrying out the present invention. The invention is, however, susceptible to modifications and alternate constructions from the embodiments shown in the drawing and described above. Consequently, it is not the intention to limit this invention to the particular embodiments disclosed. On the contrary, the intention is to cover all modifications and alternate constructions falling within the spirit and scope of the invention as expressed in the appended claims.

What is claimed is:

1. A tilting bracket tool adapted for connection to a smoothing plate, comprising:

a base plate;

a yoke pivotably mounted to the base plate, said yoke having means defining a passageway therein, which passageway has an axis that is disposed generally at a right angle to the axis about which the yoke pivots;

handle receiving means extending through the passageway with the forward end thereof extending beyond the yoke pivot axis, which handle receiving means is adapted to rotate while being retained in the passageway; and a rod having one ball and socket end universally and operably secured to the forwardly located end of said handle receiving means and another ball and socket end universally and operatively secured to the base plate at a location forward of the base plate pivot axis to allow the end of the rod connected to the handle receiving means to follow the movement of the handle means as it rotates and to allow the other end connected to the base plate to pivot about a point so that the longitudinal axis of the rod inscribes a cone as it moves during rotation of the handle receiving means, thereby tilting the base plate.

2. The tool of claim 1 wherein the rod is in two pieces adjustably connected together by a threaded stud member.

3. The tool of claim 1 including a braking element to hold the base plate in a preselected position.

4. The tool of claim 3 wherein the braking element comprises a cylinder sleeve made of a plastic that generates frictional forces between itself and the handle receiving means which passes through the sleeve, with the external surface of the handle receiving means engaging the inside surface of the sleeve.

5. The tool of claim 4 wherein the plastic is nylon.

6. The tool of claim 3 wherein the braking element comprises adjustable means in the yoke which bear against the external surface of the handle means.

7. The tool of claim 1 wherein the handle receiving means is retained in a position by means which prevent longitudinal movement of the handle receiving means within the passageway but allows the handle receiving means to rotate within the passageway.

8. A tool comprising:

a base plate having a centrally located raised mounting section;

a yoke pivotably mounted to an intermediate portion of the mounting section, said yoke having a cylindrical passageway therein which is disposed generally at right angles to the axis about which the yoke pivots;

cylindrical shaped handle receiving means extending through the passageway and adapted to rotate therein;

a braking means which bears against the handle receiving means;

means for adjusting the braking force applied by the braking means to the handle receiving means; and a rod at the forward end of the tool having one end operably secured to the handle receiving means and another end operatively secured to the base plate at a location forward of the yoke's pivot axis, with the means for connecting the rod being adapted to allow the end of the rod connected to the handle receiving means to follow the movement of the handle means as it rotates and to allow the other end connected to the base plate to pivot about a point so that the longitudinal axis of the rod inscribes a cone as it moves during rotation of the handle means, thereby tilting the base plate.

9. The tool of claim 8 wherein the means connecting the rod to the handle receiving means and base plate are a pair of ball and socket connections.

10. The tool of claim 8 wherein the braking means is made of plastic.

11. The tool of claim 10 wherein the frictional force between the braking means and the handle receiving means is overcome by rotation of the handle receiving means but is sufficient to hold the handle receiving means and the base plate in a preselected position upon termination of rotation of the handle means.

12. The tool of claim 8 including means for introducing lubrication into the passageway.

13. In a concrete finishing tool having a base plate adapted to be fitted to a trowel or the like, a rotatable handle receiving means and means for adjusting the angle of incidence of the trowel to the surface to be worked, the improvement comprising:

a yoke pivotably mounted to the base plate and having an axis about which the base plate pivots;

handle receiving means housed in the yoke with the forward end thereof extending beyond said axis, said handle receiving means being adapted for rotation; and throw-rod means pivotably secured at said forwardly positioned end of the rotatable handle receiving means and pivotably secured at the other end to the base plate at a location forward of the base plate's pivot axis for tilting the base plate in response to rotation of the handle receiving means.

14. A concrete finishing tool having a base plate adapted to be fitted to a trowel, a pivot axis about which said base plate rotates, a rotatable handle receiving means and means for adjusting the angle of incidence of the trowel to the surface to be worked, the tool characterized in that:

said angle of incidence adjusting means includes throw-rod means pivotably secured at both ends at a location forward of said pivot axis, said throw rod means further characterized as having two parts being joined together by a threaded stud, and having one end connected to the rotatable handle receiving means and the other end pivotably secured to the base plate.

* * * * *